US006923019B2

(12) United States Patent
Kawakubo et al.

(10) Patent No.: US 6,923,019 B2
(45) Date of Patent: Aug. 2, 2005

(54) HEAT EXCHANGER

(75) Inventors: Masaaki Kawakubo, Obu (JP); Etsuo Hasegawa, Nagoya (JP); Ken Muto, Toyota (JP)

(73) Assignee: Denso Corporation, Kariya (JP)

( * ) Notice: Subject to any disclaimer, the term of this patent is extended or adjusted under 35 U.S.C. 154(b) by 126 days.

(21) Appl. No.: 10/685,794

(22) Filed: Oct. 15, 2003

(65) Prior Publication Data

US 2004/0104016 A1 Jun. 3, 2004

(30) Foreign Application Priority Data

Oct. 17, 2002 (JP) ..... 2002-302915

(51) Int. Cl.[7] ..... F25B 39/04

(52) U.S. Cl. ..... 62/506; 62/498; 62/513; 165/148

(58) Field of Search ..... 62/490, 498, 506, 62/513, 515, 519, 525; 165/148

(56) References Cited

U.S. PATENT DOCUMENTS 6,250,103 B1 * 6/2001 Watanabe et al. ..... 62/509

FOREIGN PATENT DOCUMENTS

JP 2001-221580 8/2001

* cited by examiner

*Primary Examiner*—Melvin Jones
(74) *Attorney, Agent, or Firm*—Harness, Dickey & Pierce, PLC

(57) ABSTRACT

In a high-pressure side heat exchanger for a vapor compression refrigerant cycle, a refrigerant passage is formed such that a flow area (S), a length (L), and an equivalent diameter (d) satisfy the conditional expression $0.04\times e^{-1.8d} \leqq S/L \leqq 2.1\times e^{-1.8d}$. The flow area (S) is obtained by dividing the product of a total cross-sectional area of the passages in one tube and the number of tubes by the path number. The length (L) is a flow distance of the refrigerant from the refrigerant inlet to the refrigerant outlet. That is, the length (L) is obtained by the product of the length of the tube and the path number. The diameter (d) is obtained by dividing the product of four and the cross-sectional area of the passage by a circumference of the passage.

12 Claims, 5 Drawing Sheets

HEAT EXCHANGER

CROSS REFERENCE TO RELATED APPLICATION

This application is based on Japanese Patent Application No. 2002-302915 filed on Oct. 17, 2002, the disclosure of which is incorporated herein by reference.

FIELD OF THE INVENTION

The present invention relates to a high-pressure side heat exchanger of a vapor compression refrigerant cycle, which uses carbon dioxide as a refrigerant.

BACKGROUND OF THE INVENTION

As an example of a high pressure side heat exchanger, in a radiator disclosed in JP-A-2001-221580, the insides of header tanks, which are connected to longitudinal ends of tubes, are respectively divided into two tank spaces. The refrigerant reverses flow direction twice while flowing through the radiator from a refrigerant inlet to a refrigerant outlet. Thus, three broad paths of the refrigerant flow are formed when the radiator is viewed in broad perspective. The number of the path is obtained by adding one to the number of times that the refrigerant reverses flow in the radiator.

In general, when a flow area of a refrigerant passage is small, the velocity of flow of the refrigerant is high, so efficiency of heat transfer increases and compressive strength improves. Therefore, it is possible to reduce the heat exchanger in size and weight.

On the other hand, when the flow area is excessively small, pressure loss in the refrigerant passage increases, resulting in decrease in the flow rate. In this case, it is required to increase the numbers of the tubes defining the refrigerant passages and thereby to restrict the decrease in the flow rate. However, this results in the increase of the heat exchanger in size and weight.

SUMMARY OF THE INVENTION

The present invention is made in view of the foregoing matter and it is an object of the present invention to provide a heat exchanger suitable for a high pressure side heat exchanger of a vapor compression refrigerant cycle.

According to the present invention, a heat exchanger for a vapor compression refrigerant cycle defines a passage through which a refrigerant having a pressure equal to or higher than a predetermined pressure flows. The heat exchanger is provided such that a flow area (S) of the refrigerant, a length (L) of the passage, and an equivalent diameter (d) of the passage satisfy the conditional expression $0.04\times e^{-1.8d} \leqq S/L \leqq 2.1\times e^{-1.8d}$.

Accordingly, the heat exchanger achieves high performance. Preferably, the refrigerant is carbon dioxide. The refrigerant is supplied from a compressor of the vapor compression refrigerant cycle and has a pressure equal to or higher than a critical pressure.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

An embodiment of the present invention will be described hereinafter with reference to the drawings.

Figure 1:
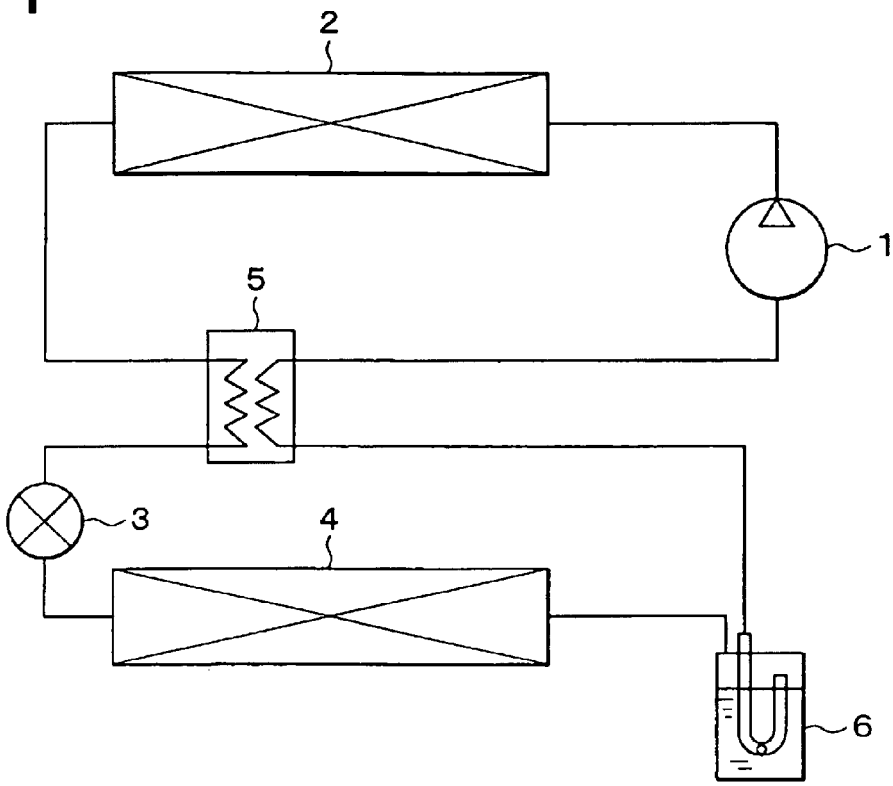
FIG. 1 is a schematic diagram of a vapor compression refrigerant cycle according to an embodiment of the present invention.

In the embodiment, the present invention is employed in an air conditioning unit including a vapor compression refrigerant cycle using carbon dioxide as a refrigerant. The vapor compression refrigerant cycle generally has a compressor 1, a radiator 2, a pressure reducing device 3, and an evaporator 4. In the embodiment, the vapor compression refrigerant cycle further includes an internal heat exchanger 5 and a gas-liquid separator 6, as shown in FIG. 1. The internal heat exchanger 5 performs heat exchange between the refrigerant to be sucked into the compressor 1 and the refrigerant having been discharged from the radiator 2. The gas-liquid separator 6 separates the refrigerant, which has been discharged from the evaporator 4, into a gas refrigerant and a liquid refrigerant and stores surplus refrigerant in a phase of liquid refrigerant. Also, the gas-liquid separator 6 discharges the gas refrigerant toward an inlet side of the compressor 1.

Here, the refrigerant having been discharged from the compressor 1 has a pressure equal to or higher than a critical pressure. The refrigerant is introduced into the radiator 2 through a pipe. In the radiator 2, the refrigerant is cooled without condensing, thereby an enthalpy is reduced. With regard to the pressure reducing device 3, a throttle degree is controlled so that a coefficient of performance of the vapor compression refrigerant cycle is substantially on a maximum level.

Figure 2:
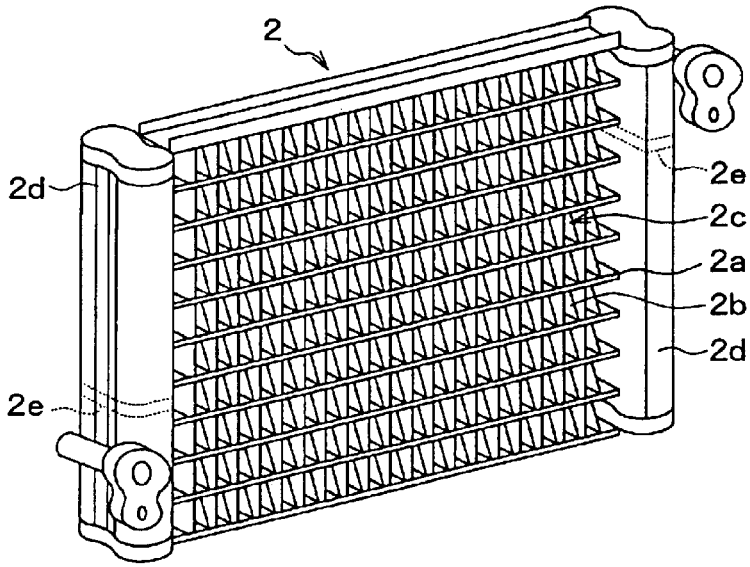
FIG. 2 is a perspective view of a radiator according to the embodiment of the present invention.
Figure 4:
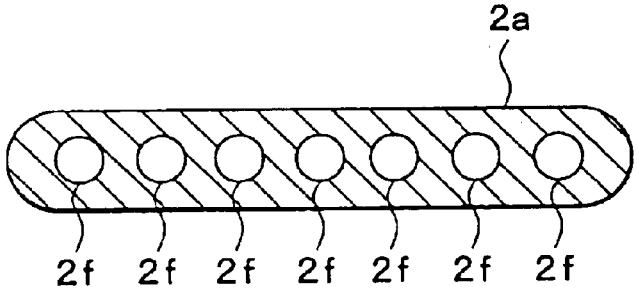
FIG. 4 is a cross-sectional view of a tube of the radiator according to the embodiment of the present invention.

As shown in FIG. 2, the radiator 2 has a core portion 2*c* and header tanks 2*d*. The core portion 2*c* performs heat exchange between the refrigerant and air (outside fluid) passing through the core portion 2*c*. The core portion 2*c* includes tubes 2*a* and fins 2*b*. The tubes 2*a* are substantially flat. Each of the tubes 2*a* defines a plurality of passages 2*f* through which the refrigerant flows, as shown in FIG. 4. The fins 2*b* are joined to the outer surfaces of the tubes 2*b* by brazing. The fins 2*b* increases an area of heat-transfer surface, thereby facilitating the cooling of the refrigerant.

Figure 3:
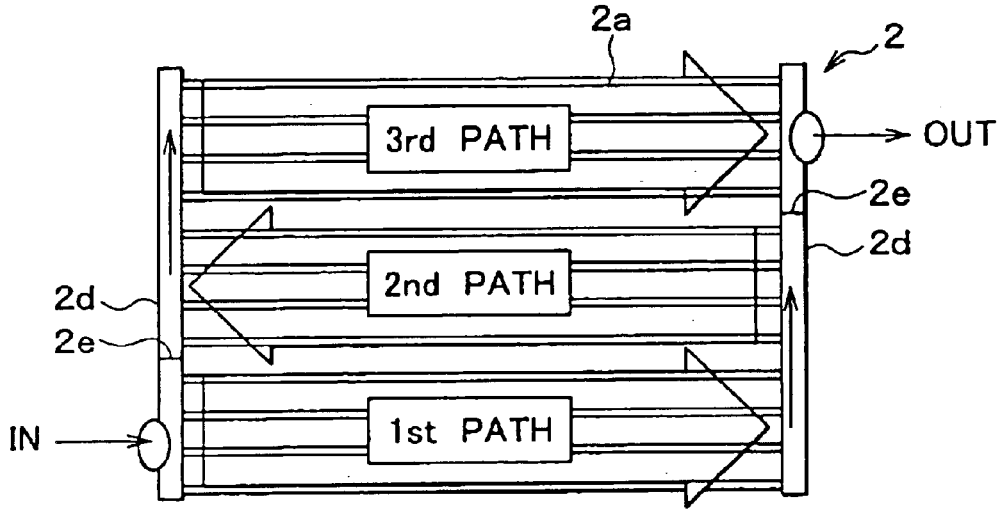
FIG. 3 is a schematic plan view of the radiator for explaining a broad flow of a refrigerant in the radiator according to the embodiment of the present invention.

The header tanks 2*d* are connected to longitudinal ends of the tubes 2*a* such that longitudinal axes of the header tanks 2*d* are perpendicular to the longitudinal directions of the tubes 2*a*. The header tanks 2*d* communicate with the tubes 2*a*. The inside of each of the header tanks 2*d* is divided into a plurality of spaces by a separator 2*e*. In the embodiment, the inside of the header tank 2*d* is divided into two spaces. Therefore, in the radiator 2, the refrigerant reverses flow twice while flowing from a refrigerant inlet to a refrigerant outlet. As shown in FIG. 3, three broad paths of the refrigerant flow are formed in the radiator 2. Here, the path is a broad flow of the refrigerant in one direction when the radiator 2 is viewed in broad perspective. Therefore, the path number is obtained by adding one to the number of times that the refrigerant reverses flow. In the embodiment, the path number is three.

Further, dimensions of respective parts of the radiator 2 is determined such that a refrigerant flow area S, a refrigerant passage length L and an equivalent diameter d of the refrigerant passage satisfy the following conditional expression 1.

$$0.04\times e^{-1.8d} \leqq S/L \leqq 2.1\times e^{-1.8d} \quad (1)$$

Here, the refrigerant flow area S is a flow area of the refrigerant if the refrigerant flows straight from the refrigerant inlet to the refrigerant outlet. More specifically, the refrigerant flow area S is obtained by dividing the product of a total flow area (cross-sectional area) of the passages 2*f* of one tube 2*a* and the number of the tubes 2*a* by the path number.

The refrigerant passage length L is a flow distance of the refrigerant from the refrigerant inlet to the refrigerant outlet. In the embodiment, the refrigerant passage length L is obtained by the product of the length of the tube 2*a* and the path number. The equivalent diameter d is a dimension that is represented by 4×A/P. Here, symbol A represents the flow area (cross-sectional area) of the refrigerant passage 2*f*. Symbol P represents a circumferential length of the refrigerant passage 2*f*.

Figure 5:
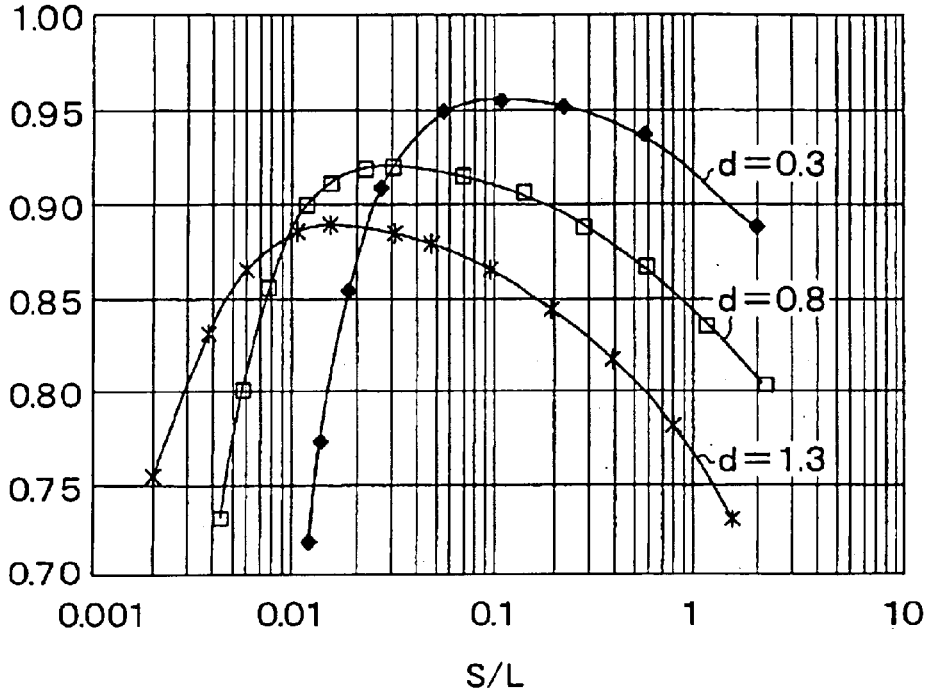
FIG. 5 is a graph for showing relationship between a ratio of a refrigerant passage length L to a refrigerant passage area S and a heat radiating performance of the radiator.
Figure 6:
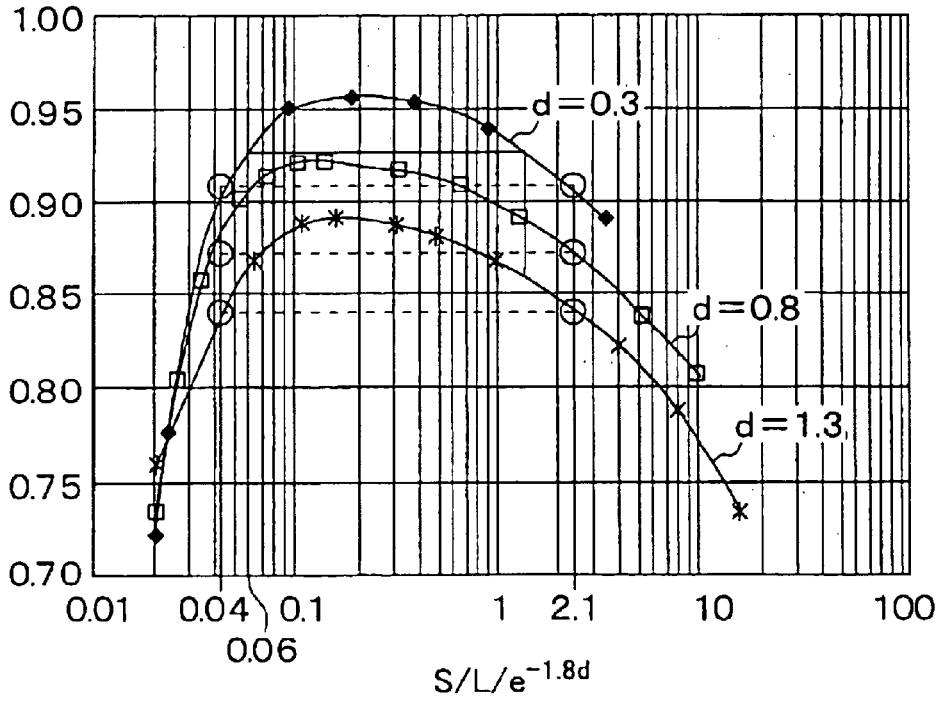
FIG. 6 is a graph for showing relationship between a ratio of a refrigerant passage length L to a refrigerant passage area S and a heat radiating performance of the radiator.

FIGS. 5 and 6 show relationship between a passage area ratio and a performance ratio of the radiator 2 obtained by simulation of the equivalent diameters d as parameters. Here, the equivalent diameters d are for example 0.3, 0.8, and 1.3 that are within usual use range. Also, the passage area ratio is the ratio of the refrigerant passage length L to the refrigerant flow area S.

In FIG. 5, a range or point of the passage area ratio where the performance ratio is on a maximum level differs according to the equivalent diameters d.

In FIG. 6, on the other hand, a horizontal axis represents a value that is obtained by dividing the passage area ratio by $e^{-1.8d}$.

In this case, similar performance curves are shown irrespective of the equivalent diameters d at least within the range between 0.3 to 1.3. That is, the three performance curves have peaks within in substantially the same range with respect to the horizontal axis, irrespective of the equivalent diameter d.

When the value obtained by dividing the passage area ratio by $e^{-1.8d}$ is within the range between equal to or greater than 0.04 and equal to or less than 2.1, the radiator 2 achieves high level of performance. Further, when the value obtained by dividing the passage area ratio by $e^{-1.8d}$ is within the range between equal to or greater than 0.06 and equal to or less than 1.0, the radiator 2 achieves higher performance.

Figure 7:
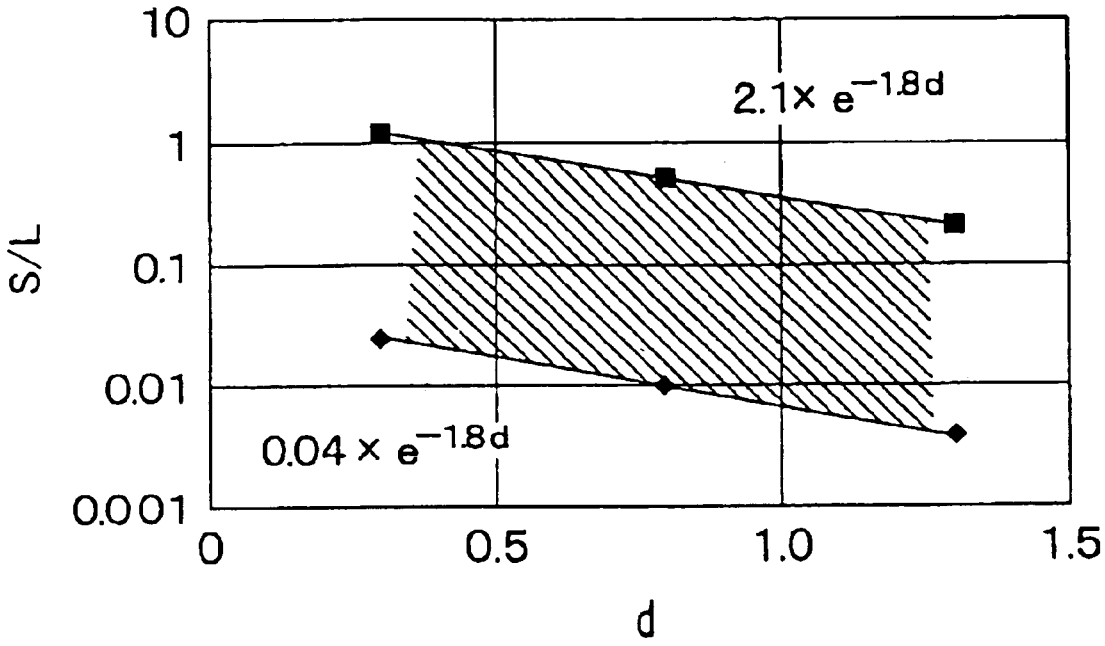
FIG. 7 is a graph for showing performance of the radiator based on a conditional expression 1 according to the embodiment of the present invention.

Accordingly, when the refrigerant flow area S, the refrigerant passage length L and the equivalent diameter d satisfy the condition of the expression 1, the radiator 2 achieves high heat radiating performance. FIG. 7 shows a relationship of the equivalent diameter d and the passage area ratio of the,radiator 2 based on the conditional expression 1. In FIG. 7, a shaded area represents a high performance area.

In the embodiment, the header tanks 2*d* are divided by the separators 2*e* and the broad flow of the refrigerant is reversed in the radiator 2. However, the present invention is not limited to the above. For example, the present invention can be employed to a single flow direction-type heat exchanger that does not have the separators 2*e* in the header tanks 2*d* so that the refrigerant flows in the same direction. Also, the present invention can be employed to a back and forth multiple reverse flow-type heat exchanger in which a plurality of core portions are provided with respect to a flow direction of air and the refrigerant makes turns and cross-flow. As further another example, the present invention can be employed to a serpentine-type heat exchanger that has a serpentine tube.

In the above embodiment, the pressure of the refrigerant is reduced in isenthalpic by the pressure reducing device 3. However, instead of the pressure reducing device 3, the pressure of the refrigerant can be reduced in isentropic such as by an expansion device or an ejector having a nozzle.

In the above embodiment, the vapor compression refrigerant cycle has the internal heat exchanger 5. However, the internal heat exchanger 5 is not always necessary.

Although the discharge pressure of the compressor 1 is equal to or greater than the critical pressure of the refrigerant. However, the present invention is not limited to this. In addition, the refrigerant is not limited to carbon dioxide.

Figure 8A:
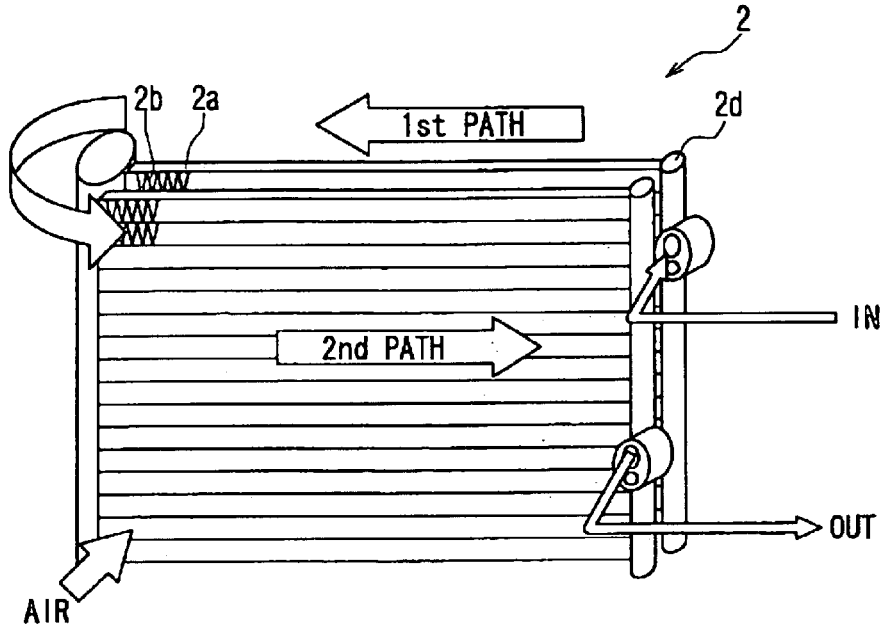
FIG. 8A is a perspective view of a radiator for explaining a broad flow of a refrigerant according to a modification of the embodiment of the present invention.
Figure 8B:
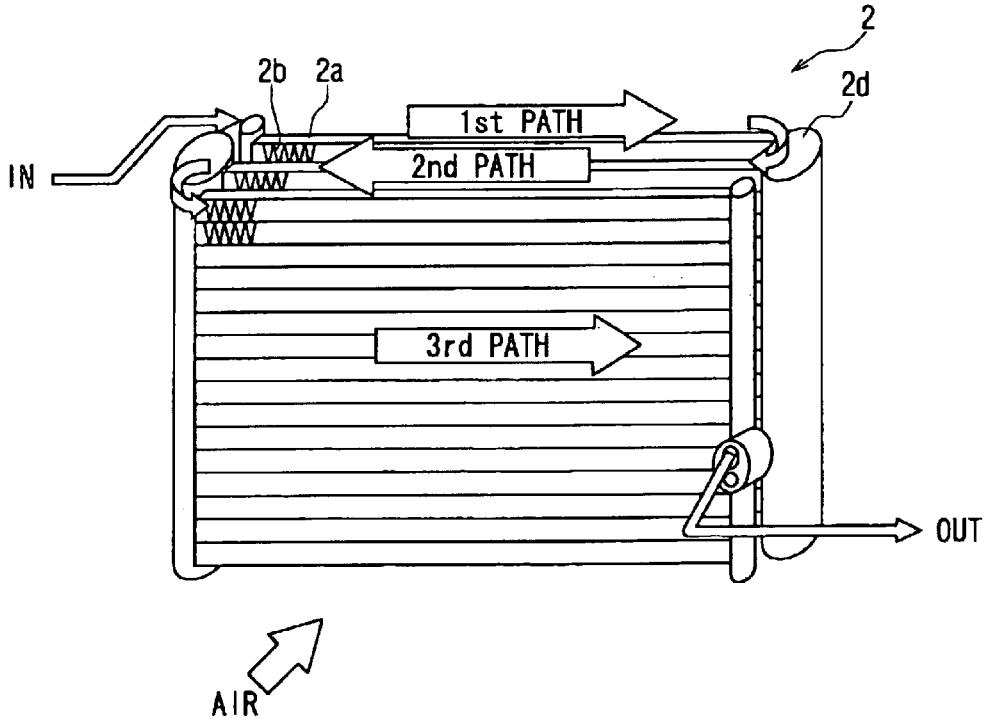
FIG. 8B is a perspective view of a radiator for explaining a broad flow of a refrigerant according to a modification of the embodiment of the present invention.

Furthermore, the flow-type of the refrigerant of the embodiment is not limited to that shown in FIG. 3. For example, the flow of the refrigerant can be formed as shown in FIGS. 8A and 8B. That is, the tubes 2*a* are arranged in a plurality of rows with respect to the air flow direction so that a plurality of paths can be formed with respect to the air flow direction. In FIG. 8A, two paths are formed. In FIG. 8B, three paths are formed.

The present invention should not be limited to the disclosed embodiments, but may be implemented in other ways without departing from the spirit of the invention.

What is claimed is:

1. A heat exchanger for a vapor compression refrigerant cycle, defining a passage through which a refrigerant having a pressure equal to or higher than a predetermined pressure flows, wherein a refrigerant flow area (S), a length (L), and an equivalent diameter (d) of the passage satisfy the conditional expression $0.04\times e^{-1.8d} \leqq S/L \leqq 2.1\times e^{-1.8d}$.

2. The heat exchanger according to claim 1, wherein the flow area (S), the length (L)and the equivalent diameter (d) of the passage satisfy the conditional expression $0.06\times e^{-1.8d} \leqq S/L \leqq 1.0\times e^{-1.8d}$.

3. The heat exchanger according to claim 1, comprising:

a core portion including a plurality of tubes defining the passages therein and fins interposed between the tubes, wherein the core portion performs heat exchange between the refrigerant and an outside fluid passing outside of the tubes; and a header tank connected to longitudinal ends of the tubes to communicate with the tubes.

4. The heat exchanger according to claim 3, further comprising:

a separator disposed in the header tank for dividing an inside of the header tank into a plurality of spaces.

5. The heat exchanger according to claim 1, wherein the vapor compression refrigerant cycle includes a compressor for compressing the refrigerant, and the refrigerant, which has been discharged from the compressor, flows through the passages.

6. The heat exchanger according to claim 1, wherein the refrigerant is carbon dioxide.

7. The heat exchanger according to claim 1, wherein the predetermined pressure is a critical pressure of the refrigerant.

8. A vapor compression refrigerant cycle comprising:

a compressor for compressing a refrigerant; and a heat exchanger for cooling the refrigerant, wherein the heat exchanger includes tubes defining refrigerant passages through which the refrigerant flows therein and header tanks connected to longitudinal ends of the tubes, wherein the passages are defined such that a flow area (S), a length (L), and an equivalent diameter (d) satisfy the conditional expression $0.04\times e^{-1.8d} \leqq S/L \leqq 2.1e^{-1.8d}$.

9. The vapor compression refrigerant cycle according to claim 8, wherein the passages are defined such that the flow area (S), the length (L), and the equivalent diameter (d) satisfy the conditional expression $0.06\times e^{-1.8d} \leqq S/L \leqq 1.0\times e^{-1.8d}$.

10. The vapor compression refrigerant cycle according to claim 8, wherein the refrigerant is carbon dioxide and compressed by a pressure equal to or higher than a critical pressure.

11. The vapor compression refrigerant cycle according to claim 8, wherein the equivalent diameter (d) is obtained by dividing the product of four and a cross-sectional area of one passage by a circumference of the passage.

12. The vapor compression refrigerant cycle according to claim 8, the heat exchanger further includes a separator provided in at least one of the header tanks such that the refrigerant reverses flow in at least one of the header tanks, wherein the length (L) is obtained by the product of the length of the tube and the number of path, wherein the number of path is obtained by adding the number of times that the refrigerant reverses flow to one, and wherein the flow area (S) is obtained by dividing the product of a total cross-sectional area of the passages in one tube and the number of tubes by the number of path.

* * * * *